US005171933A

United States Patent [19]

Eldering

[11] Patent Number: 5,171,933

[45] Date of Patent: Dec. 15, 1992

[54] DISTURBED-GUN AIMING SYSTEM

[75] Inventor: Herman G. Eldering, Chelmsford, Mass.

[73] Assignee: IMO Industries, Inc., Princeton, N.J.

[21] Appl. No.: 811,786

[22] Filed: Dec. 20, 1991

[51] Int. Cl.[5] ..... F41G 3/22

[52] U.S. Cl. ..... 89/41.06; 89/41.21; 235/414; 364/423

[58] Field of Search ..... 89/41.06, 41.07, 41.19, 89/41.21; 235/411, 412, 413, 414, 415, 416, 417; 364/423

[56] References Cited

U.S. PATENT DOCUMENTS 2,464,195 3/1949 Burley et al. ..... 89/41.21

2,561,924 7/1951 Hellen ..... 89/41.21

*Primary Examiner*—Stephen C. Bentley

*Attorney, Agent, or Firm*—Hopgood, Calimafde, Kalil, Blaustein & Judlowe

[57] ABSTRACT

A manually movable gun is mounted to a platform with a limited range of correctional computer-controlled updated reorientation in azimuth and in elevation with respect to the platform. The platform fixedly mounts a sighting-rangefinder system, so that correctional reorientation of the gun is a correctional reorientation with respect to the sighting axis of the sighting/rangefinder system. The platform is mounted for two-axis freedom to be moved in azimuth and in elevation. The gunner must so move the gun platform, and at the same time thereby so move his sight, that the sighting alignment is kept on the target. In the course of such movement to keep the sighting line on the target, sensors and detectors of target range and of the components of platform movement in its mount, as well as sensors of other ballistic parameters, feed their output to circuitry including a computer. The computer derives range rate and the two components of the orientation rate of the platform, and provides a calculated output of the necessary two components of trim adjustment of the gun with respect to its mounting platform. Such correctional adjustments are effected by computer control of trim-adjustment motors, in azimuth and in elevation, while the operator keeps his sighting line on the target. The loop of computer calculation in response to updating sensor outputs and range and bearing data is so fast as to reduce the near-insignificance of the time delay of computer calculation and motordriven correctional orientation of the gun, as long as the operator keeps his sight in line on the target. He therefore need not wait to fire a machine-gun burst even while the correctional adjustments are still being made.

12 Claims, 3 Drawing Sheets

FIG.4A
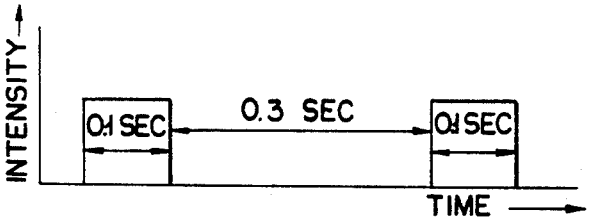
FIG.4B
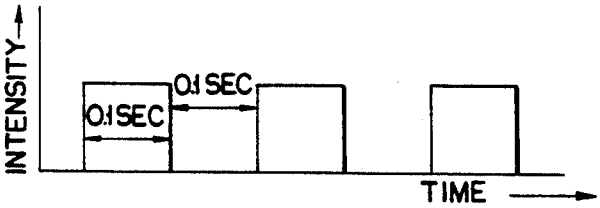
FIG.4C
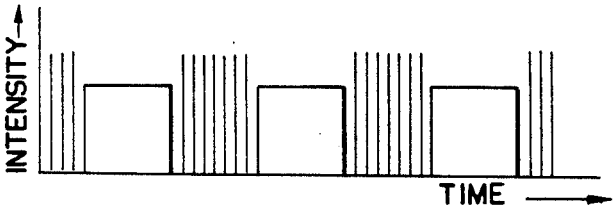
FIG.4D
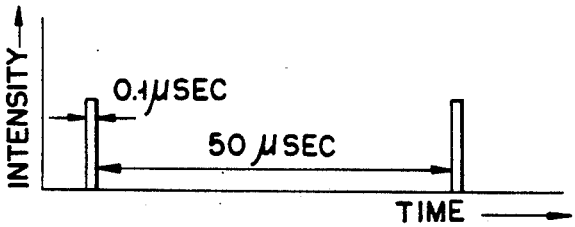
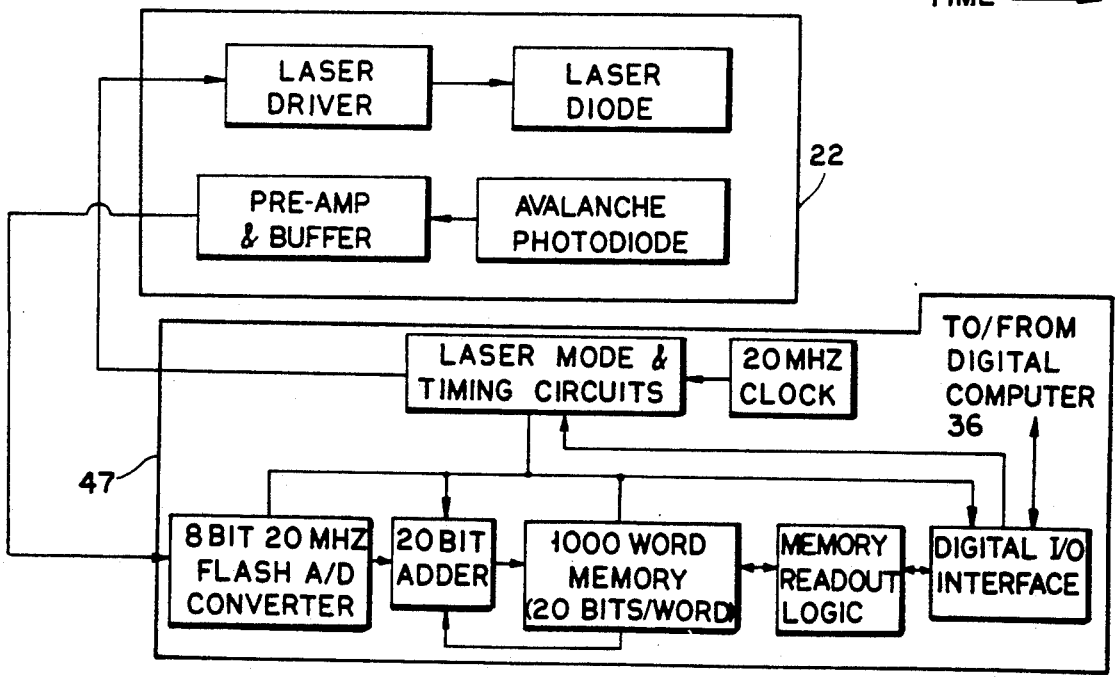
FIG. 5

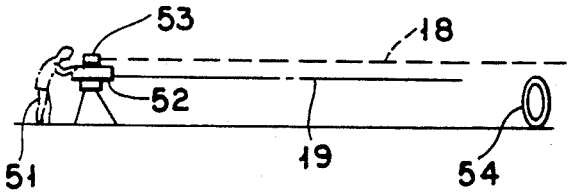
FIG. 6A
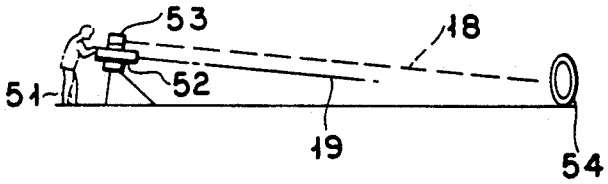
FIG. 6B
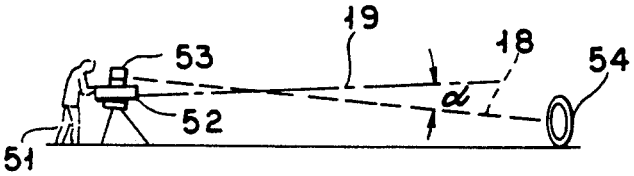
FIG. 6C
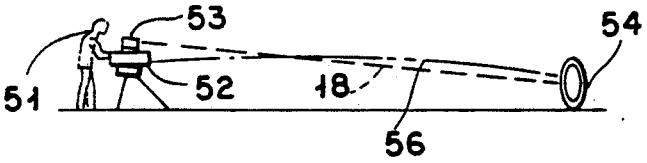
FIG. 6D
FIG. 7A
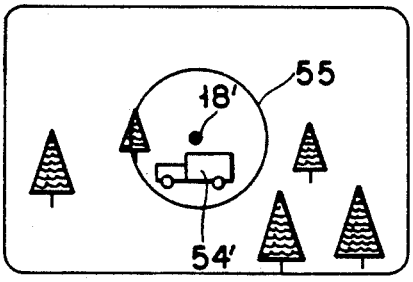
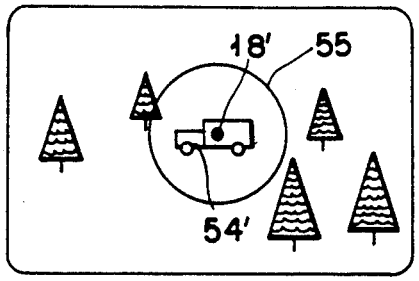
FIG. 7B
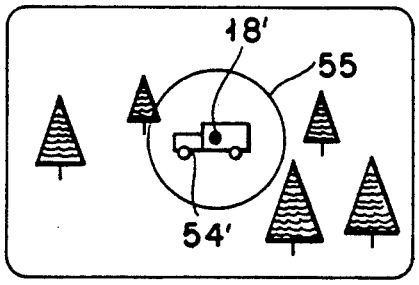
FIG. 7C
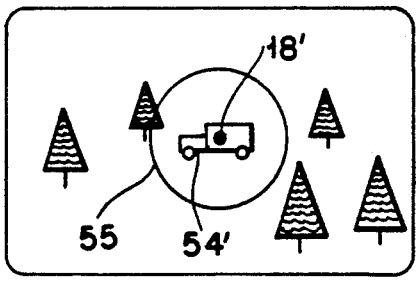
FIG. 7D

DISTURBED-GUN AIMING SYSTEM

BACKGROUND OF THE INVENTION

The invention pertains to gun-aiming systems involving computation of the lead angle and ballistic drop by which, for ballistic reasons, the gun bore alignment must "lead" and be "above" a given sighted target when the gun is fired.

Gun sights are of non-computing and computing varieties. Generally speaking, non-computing sights are either "iron" sights or "optical" sights, with either of which the gunner manually moves the gun until the part of the sight or reticle that corresponds to his estimated range and lead angle is lined up with the target, before he fires the gun and selects another target.

Heavier guns, such as turret-mounted guns used in Abrams tanks and Apache helicopters, employ so-called computed aim-point sights, which incorporate sensors to obtain target range and velocity to compute an aim point. This type of sight is a gun director, which moves the gun to the correct firing position independent of the sight motion. The gunner can smoothly track the target, using the sight, essentially unaware of gun motion.

Between the above-noted extremes are guns, such as 0.50-caliber machine guns on helicopters, boats and land vehicles, as well as larger weapons such as recoilless rifles. In this category, the weapon is manually moved, being gimbal-mounted for two-axis freedom for orientation in azimuth and in elevation in response to torques supplied by the gunner. A computing sight for such a gun generally provides the gunner with two spots in the sight and is termed a "disturbed-reticle" sight. The first spot is on boresight and is used by the gunner to initially track the target, thereby providing information such as range and angular rate to a ballistic computer. After completing the computations, a second point (e.g., a reticle) is displayed to designate the bullet-impact point. The gunner then physically moves the gun and sight to place the bullet-impact point on the target and fires.

One form of disturbed-reticle sight uses a laser beam to project the spot on the target and is called an "aiming light". In this type of sight, and after computations have been completed, the operator must move the gun such that the laser-beam spot registers with the reticle that identifies the bullet-impact point. Stated in other words, once calculations have been completed to the point of displaying the target-impact point, the gunner must transfer his attention and the aiming of his laser spot, from the target to the target-impact point which has just appeared in his display.

For weapons in a relatively slowly evolving situation, such as a recoilless rifle firing at a tank, the additional time to reposition the weapon, after completing the calculations, is not critical. On the other hand, in the case of a gun mounted to a low-flying helicopter moving at 100 knots, a more rapid response is desired.

BRIEF STATEMENT OF THE INVENTION

It is an object of the invention to provide a gun-sighting system which is an improvement over disturbed-reticle systems.

It is a specific object to achieve the above object with a sighting system which enables a gunner to continuously keep his sighting spot on the target, i.e., which requires the gunner to so move the gun, even while calculations are proceeding, that his sighting spot is maintained on the target, up to and including the time of firing the gun.

Another object is to meet the above objects with a system which provides the gunner with an indication in which he sees, through his view of the sighting spot on the target, that corrective gun-boresight orientation has been effected.

The invention achieves these objects for a manually movable gun wherein the gun is mounted to a platform with a limited range of correctional computer-controlled updated reorientation in azimuth and in elevation with respect to the platform. The platform fixedly mounts a sighting/rangefinder system, so that correctional reorientation of the gun is a correctional reorientation with respect to the sighting axis of the sighting-/rangefinder system. The platform is mounted for two-axis freedom to be moved in azimuth and in elevation. The gunner must so move the gun platform, and at the same time thereby so move his sight, that the sighting alignment is kept on the target. In the course of such movement to keep the sighting line on the target, sensors and detectors of target range and of the components of platform movement in its mount, as well as sensors of other ballistic parameters, feed their outputs to circuitry including a computer. The computer derives range rate and the two components of the orientation rate of the platform, and provides a calculated output of the necessary two components of trim adjustment of the gun with respect to its mounting platform. Such correctional adjustments are effected by computer control of trim-adjustment motors, in azimuth and in elevation, while the operator keeps his sighting line on the target. The loop of computer calculation in response to updating sensor outputs and range and bearing data is so fast as to reduce to near-insignificance the time delay of computer calculation and motor-driven correctional orientation of the gun, as long as the operator keeps his sight in line with the target. He therefore need not wait to fire a machine-gun burst even while the correctional adjustments are still being made.

DETAILED DESCRIPTION

The invention will be illustratively described in detail, in conjunction with the accompanying drawings, in which:

FIGS. 4A to 4C are a succession of like graphs of intensity versus the same time scale, to illustrate specific facets of a combined sight and rangefinder in the system of FIGS. 1 to 3;

FIG. 4D is a graph of intensity versus time, wherein the time base of a portion of FIG. 4C has been greatly expanded;

FIG. 5 is an electrical block diagram of circuitry for the sight and rangefinder of FIGS. 1 to 4;

FIGS. 6A to 6D are a succession of like simple diagrams to illustrate stages of gun, sight and target relations in the course of a cycle of preparation for and execution of a gun-firing operation of the system of FIGS. 1 to 5; and FIGS. 7A to 7D are a succession of simplified displays viewed by the gunner, for each of the respective relationships of FIGS. 6A to 6D.

Figure 1:
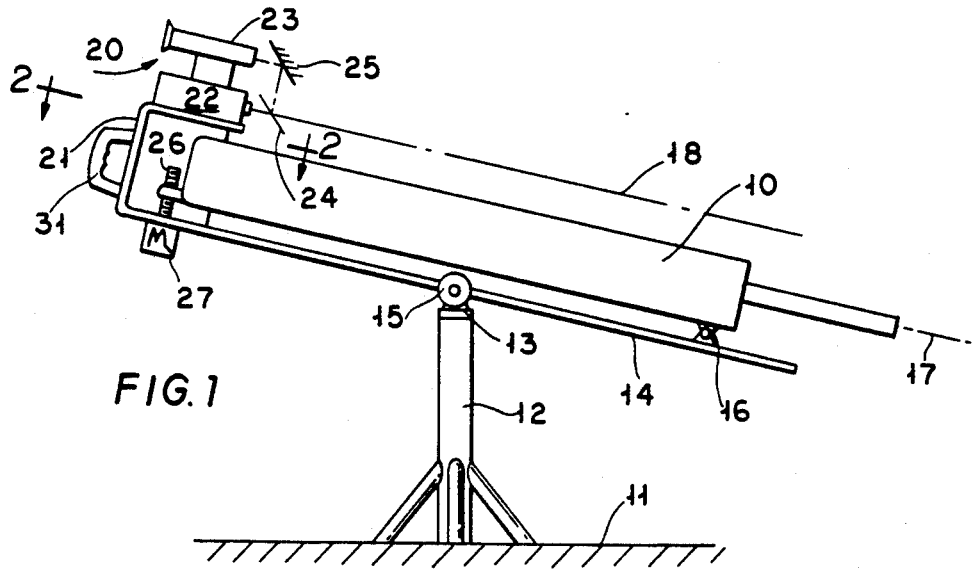
FIG. 1 is a simplified and somewhat schematic view in side elevation of a mounted gun that is equipped with a sighting system of the invention.

In FIG. 1, the invention is seen in application to a gun 10, which may be a 0.50-caliber machine gun mounted to the floor 11 of a helicopter. More specifically, the mount is seen to comprise an upstanding column 12 which establishes a vertical axis of rotational support for a gimbal base 13. A gun-supporting elongate frame or platform 14 is supported for tilting rotation about a horizontal axis established by and between spaced arms 15 of the gimbal. At its distal end, the barrel of the gun is connected to platform 14, by a joint 16 which affords a limited range of freedom to adapt to adjusted deviations of the gun axis 17 from strict parallelism to a visual-sighting axis 18. The sighting axis 18 is a property of a sighting system 20 that is fixedly mounted to bracket structure 21 at the gunner's or proximal end of platform 14.

The sighting system 20 may be any one of a variety of known systems, from a totally visual optical system, to a radar system, but for present purposes it is convenient to discuss axis 18 as that of an aiming light, i.e., the beam from a laser at 22, in conjunction with a viewing telescope or other optical device 23 at folded but parallel offset from axis 18. The optical folding is schematically suggested by a partially reflecting mirror 24 in conjunction with a fully reflecting mirror 25.

In addition to its aiming function on axis 18, the aiming light at 22, which may be a laser diode, can additionally serve a rangefinding function, by multiplexed interlacing of the two functions on the same axis 18. Illustrative interlacing is schematically shown by the simple graphical diagrams of FIGS. 4B and 4C, for repetitive cycles wherein the laser diode is turned on continuously for 1/10 second to act as an aiming light, and wherein the following 1/10 second is used for rangefinding, involving a burst of about 2,000 0.1-microsecond pulses at 50-microsecond intervals. Thus, the first half of each cycle will recur as blinks at five per second, and the second half of each cycle enables a large number of redundant range measurements to be made, one for each pulse of each burst. Circuitry to accomplish such rangefinding, by digital counting of travel time for each pulse to and reflected by the target, is discussed in an unclassified report, entitled "Final Report for B Sting [acronym for Beam Sight Technology Incorporating Night-vision Goggles]", dated January 1991, by Baird Optical Systems Division of IMO Industries Inc. for WL/MNMF, Eglin Air Force Base.

The adjusted deviations mentioned above involve a first leadscrew 26 driven by a first servomotor 27 to effect up/down displacement of the proximal end of gun 10, about the horizontal axis of articulation at 16, thus enabling adjusted up/down elevational adjustments of the gun-bore axis 17 with respect to axis 18 of optical viewing and laser-spot projection. A further right/left adjustment about the vertical axis of articulation at 16 is also available at the proximal end of the gun, but its showing would be an encumbrance in FIG. 1; reference is therefore made to FIG. 2, where the motor 27 and its leadscrew 26 are shown to be carried by a slide 28 that is transversely guided by a groove or ways in platform 14, and where a second servomotor 29 for drive of slide 28 via a leadscrew 30 is seen to be carried by platform 14.

Figure 2:
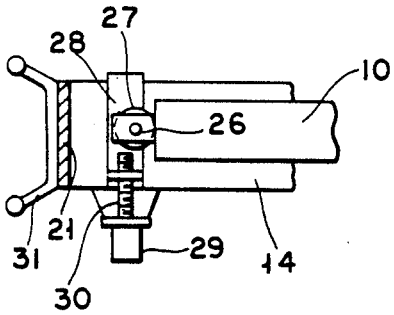
FIG. 2 is a fragmentary detail of adjustable trimming mechanism in the gun and sighting system of FIG. 1, the view being from the aspect 2—2 of FIG. 1.

A gunner's handgrip 31 on bracket 21 completes the identification of parts in FIGS. 1 and 2, and it will be seen that the gunner's job is to maneuver the platform 14 (with its sighting axis 18 fixed thereto) in combinations of (a) up/down elevational displacement about the horizontal pivot axis provided by gimbal 15 and (b) right/left azimuthal displacement about the vertical axis of rotation of the gimbal base 13. These components of rotation are of no concern to the gunner, as long as he does what is required for him to keep his sighting axis 18 on the target. In the indicated case of laser-beam projection on axis 18, the gunner will see the laser beam as a bright spot which he must hold on his view of the target.

Figure 3:
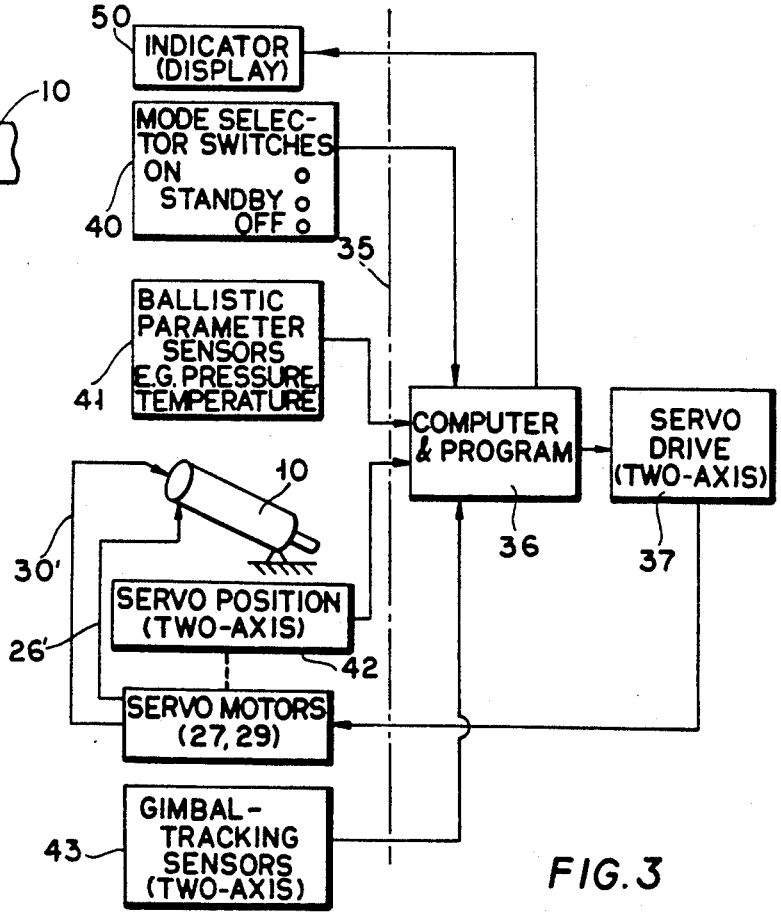
FIG. 3 is a block diagram schematically showing connections for functional components of the system of FIG. 1.

In the schematic diagram of FIG. 3, a phantom line 35 separates components carried by or directly associated with the gun 10 and its sighting equipment 20 on the one hand, and associated computer and program means 36 for bidirectional control of the two-axis servodrive means 37 for the respective servomotors 27 and 29. The respective operations of these motors are schematically indicated by an up/down actuating connection 26' and a right-left actuating connection 30' to the proximal end of gun 10.

Computer 36 is shown with a multiplicity of input connections, indicated by legend at blocks 40, 41, 42, 43. At block 40, mode-selector switches provide for selection as between "ON", "STAND-BY", and "OFF" modes of the sighting system. Block 41 symbolizes the various sensors of ballistic parameters, such as ambient pressure and temperature which must be accounted for in any computation of ballistic trajectory, for the particular gun and its ammunition, it being understood that constants and preascertained functions pertaining to the gun, its ammunition, and its performance are factors built into the algorithm and program of the computer. Block 42 symbolizes the transducers which track and supply the computer with each of the instantaneous components of angular position of the respective servomotors 27, 29; in FIG. 3, a heavy dashed-line connection is suggestive of mechanically tracking the positions of servomotors 27, 29.

In any ballistic trajectory calculation, factors such as range to the target, azimuth and elevation of the target, as well as the rate of change of azimuth and elevation of the target, all with respect to the flight axis of the helicopter (or other gun-carrying vehicle) are derivable from continuous monitoring of displacements about the respective gimbal axes. This is accomplished from angle-tracking sensors symbolized at 43 and serving the respective instantaneous horizontal-axis and vertical-axis angular positions of the gimbal suspension; such data are shown for continuous supply to computer 36.

Finally, an indicator or display unit 50 functions from a computer output connection to provide a display suited to the particular sighting system; for example, in an optically viewed field wherein the laser spot is to be kept on the target, the indicator 43 may be merely a means of changing the viewed spot on the target, as from a steady spot to an intermittent or blinking spot, thus signifying that calculations and servomotor displacements have been accomplished. Alternatively, the display at 43 may, for the case of a radar sighting system, be a cathode-ray tube display of the target in its field, with a central superposed spot signifying where the sighting axis impacts the field, relying on the gunner to do his part maneuvering the platform 14 such that the sighting-axis spot is maintained on the target.

Velocity data may be derived from rangefinder data and from the respective components of angular-rate data. the latter being available from the outputs of the respective component angle sensors (at 43) which reflect instantaneous articulation of platform 14 (and therefore also of the sighting axis 18) with respect to mount 12. Range data are illustratively determined directly from a laser-operated projection system at 22, as will be briefly discussed in connection with the diagrams of FIGS. 4 and 5.

In FIG. 4A, a succession of square waves will be understood to be like illustrative, 0.1-second laser-beam projections on axis 18 to the current field of view of the sighting system. These pulses are spaced by an interval of 0.3 second, thus accounting for a displayable spot at 50 which repeats at the visually recognizable rate of once every 0.4 second, i.e., 2.5 second; such a relatively slow rate can tell the gunner that his system is working but is not yet in the correct firing position. If on the other hand, he observes a blink rate at twice the rate of FIG. 4A, as for example depicted in FIG. 4B wherein the aiming light is "ON" twice as often and with 0.1-second intervals between pulses, he can be alerted to the fact that the gun is in the correct firing position. The computer monitors the actual gun position and the computed correct firing position. When the actual gun position is reasonably close to the computed position, the laser is commanded to the doubled rate exemplified by FIG. 4B. The expression "reasonably close" or "sufficiently close" will be understood to mean different things for different guns; specifically, the changed rate of spot display should be computer-programmed to occur only when the actual gun position is within the known bullet-dispersion spread of the involved gun. This will be a smaller dispersion criterion the better the firing accuracy of the involved gun.

FIG. 4C illustrates that in the intervals between laser-beam delivery at the doubled rate of FIG. 4B, i.e., when the laser beam is not "ON" for the relatively long duration of 0.1 second, the intervening "OFF" intervals provide for use of the laser as an echo-ranging device, as with 0.1-microsecond pulses at 50-microsecond intervals (see FIG. 4D), meaning about 2000 such pulses in each "OFF" period of the blinking-spot display. It is physically impossible to show the 2000 pulses for each "OFF" interval of FIG. 4C; therefore, multiple pulses shown will be understood to be merely a schematic illustration of such multiple pulses.

Legends in component parts of the block diagrams within the laser module 22 and within the control unit 47 of FIG. 5 are self-explanatory, and it will be understood that the optical-projection axis 18 of the laser diode of FIG. 5 is precisely coincident with the response axis 18 of laser-beam reflection, even though these are schematically separate, for the functional differences involved in beam projection on the one hand and beam-echo reception on the other hand. Basic timing of digital events and functions is shown to be provided by a 20 MHz clock-pulse generator which inter alia serves for establishing the count of travel time for each range-finding pulse of FIG. 4D, to and from the target, to the point of range-measuring detection at the photodiode of laser module 22.

A sequence of operation of the apparatus of FIGS. 1 to 5 will be described in connection with the diagrams of FIGS. 6 and 7.

In FIG. 6A, a gunner 51, his movable gun 52 and his sight 53 are shown for the instant when he turns on his equipment (e.g., by pressing the "ON" button at 40) and notes that his sighting line 18 is off his target 54. At this time, his display (FIG. 7A) shows his sighting line as a spot 18' at the center of a circular limited field 55 which happens to contain the target 54', at offset below his sight spot 18'. Based on the above discussion of FIGS. 4A to C, this will be a "slow" blinking spot at 18' because the projected beam is not on the target.

The gunner's first task is to manipulatively train the sighting line 18 by a downward displacement of his gun, to the point at which the sighting line 18 is centered on the target 54 (FIG. 6B); at this time, his display (FIG. 7B) shows his sight spot 18' on the target 54'.

The computer 36 function receives valid target range data and computes the correct gun position from currently and continuously available data signals provided by the sensors of ballistic parameters (range, range rate, angle and angular-rate components, as well as ambient pressure and temperature). Computer algorithm calculations provide two-axis drive signals for servo-drive circuitry at 37, and the respective servomotors 27, 29 provide cyclically updated correctional displacements to the proximal end of gun 10, in each of the two component directions. These servo-driven displacements will be understood to be with tight feedback control back to computer 36, based on continuous sensing (at 42) of the position (and rate of change of position) of the respective displacement means 26, 30.

As noted above, the gunner must move his gun platform 14 such that his sighting line 18 is kept on the target, so that his sighting view (of spot 18' on target 54') remains in FIG. 7C as it was in FIG. 7B, all except for such relative positional changes of non-targeted nearby objects, e.g., trees, relative to each other and to the target 54', as may appear in the display of FIG. 7C. These changes reflect changes in the gunner's viewing aspect, attributable to speed and direction of his own vehicle, but they are totally irrelevant to the described two-axis correctional calculations and displacements of means 26, 30, as long as the gunner's sighting line 18 is kept on the target. FIG. 6C shows the result of the gunner having done what he must do, namely, keep the sight line 18 on the target, and let the computer do the calculating and correcting displacements necessary to achieve two axes of angular displacement of the gun-bore correctional orientation 19 with respect to the sighting line 18. In FIG. 6C, one component of such displacement is manifest, to the extent of an angle $\alpha$.

Having effected the gun-bore correction for each of the two components of the angle $\alpha$, there is instant opportunity to fire the gun while still keeping the sighting line 18 on the target, as indicated by the doubled rate of repetition of the sight spot 18. The diagram of FIG. 6D shows the ballistic line of flight 56 for such firing to target 54, and the display viewed by the gunner is seen in FIG. 7D to be exactly as described in FIGS. 7B and 7C, because the gunner has necessarily had to have kept his sight spot 18' on the target 54' throughout the period of calculation and lead-angle correctional displacement.

What is claimed is:

1. A gun-sighting system particularly for stationary use or for use on a moving vehicle and as long as a gun operator keeps the system sighted on a given selected target, said system comprising:

a gun and a gun-supporting platform with motor-operated means for adjustably training the bore axis of said gun in azimuth and in elevation with respect to said platform, range-finding sighting apparatus fixedly mounted to said platform and establishing a sighting alignment with respect to which said gun is adjustably trainable by said motor-operated means, means for mounting said platform for an operator to train said platform and said range-finding sighting apparatus in azimuth and in elevation, whereby to enable the operator to so train his sighting alignment as to keep the same continuously on the selected target, said apparatus providing continuously updated electrical-output signals of range data on the sighting alignment, sensor means associated with said platform-mounting means for producing output signals reflecting instantaneous azimuth and elevation condition of said platform with respect to said platform-mounting means, means including a computer connected for response to output signals of said sensor means and for response to said output signals of range data, said computer means being programmed to compute and to provide an output of data signals for ballistic correction of said gun with respect to said platform, and drive connections responding to the gun-training data output signals of said computer for correctively driving said motor-operated means, whereby, as long as the operator so continuously trains the gun platform as to continuously keep his sight aimed on the target, ballistic corrections will be automatically made in the bore-axis orientation of the gun.

2. The gun-sighting system of claim 1, wherein said motor-operated means comprises separate motor-operated azimuth-adjustment means and motor-operated elevation-adjustment means, and wherein said computer-output signals comprise separate azimuth and elevation correction signals for concurrent and independent drive control of the respective motor-operated adjustment means.

3. The gun-sighting system of claim 1, wherein separate azimuth-sensitive and elevation-sensitive sensors associated with said platform and said gun continuously track the instantaneous azimuthal and elevational condition of said gun with respect to said platform, said sensors producing electrical signals connected for feedback supply to said computer.

4. The gun-sighting system of claim 1, wherein said drive connections and said motor-operated means comprise an azimuth-correcting servosystem and an elevation-correcting servosystem.

5. The gun-sighting system of claim 1, further comprising sensors of ambient temperature and pressure for producing electrical-signal outputs to said computer.

6. The gun-sighting system of claim 1, in which said range-finding sighting apparatus comprises a laser and optical means for directing the output beam of said laser on the sighting alignment, and display means for operator viewing of his current field of view wherein the display includes a spot indicative of instantaneous impingement of the laser beam in the field of view.

7. The gun-sighting system of claim 6, in which the displayed field is always centered on the sighting alignment, whereby the displayed spot is always central to the displayed field.

8. The gun-sighting system of claim 7, in which the display includes a circular reticle surrounding and centered on the spot at such radius as to assist the operator's acquisition and retention of the spot on the target.

9. The gun-sighting system of claim 6, wherein said laser includes control means for determining a repetitive cycle of laser-beam projection in which the beam is intermittently projected at a visually observable rate of repetition and with a visually observable dwell between the visually observable projections, and an echo-ranging system of high-frequency short-pulse operation of said beam in dwell intervals between beam projections at the visually observable rate, said echo-ranging system including detecting and range-measuring circuitry redundantly operative on received short-pulse echo signals on the sighting alignment for producing an effectively continuously updated range-measurement signal output to said computer.

10. The gun-sighting system of claim 9, in which said computer is (a) connected and programmed to monitor the actual gun position and the computed correct firing position and (b), when sufficiently close to the computed position, to initiate a visually observable change in the rate at which said spot is produced in said display.

11. The gun-sighting system of claim 10, in which the initiated change in the rate of spot display is a doubling of the rate at which the spot is displayed after the actual gun position has sufficiently attained the computed position.

12. The gun-sighting system of claim 11, in which prior to detected target acquisition the dwells between periods of spot display are three times the duration of each laser-beam projection for spot display, and in which after detected beam acquisition the dwells between spot display are equal to the duration of each laser-beam projection for spot display.

* * * * *